US006570107B1

(12) United States Patent
Nishimoto et al.

(10) Patent No.: US 6,570,107 B1
(45) Date of Patent: May 27, 2003

(54) MULTIPLE-OPERATION SWITCH

(75) Inventors: Takumi Nishimoto, Okayama (JP); Koji Ono, Okayama (JP); Jun Sato, Okayama (JP); Tetsuya Fukuda, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/676,751

(22) Filed: Oct. 2, 2000

(30) Foreign Application Priority Data

Oct. 4, 1999 (JP) ..... 11-282744

(51) Int. Cl.[7] ..... H01H 19/00
(52) U.S. Cl. ..... 200/6 R; 200/6 A
(58) Field of Search ..... 200/4, 6 R, 5 R, 200/6 A, 17 R, 18, 1 B, 332, 335, 339, 553, 560, 570

(56) References Cited

U.S. PATENT DOCUMENTS 4,286,127 A 8/1981 Quitoschinger
4,769,516 A 9/1988 Allen
5,430,262 A 7/1995 Matsui et al.
5,952,628 A * 9/1999 Sato et al. ..... 200/4
6,049,044 A * 4/2000 Mizobuchi ..... 200/4
6,118,086 A * 9/2000 Isikawa ..... 200/6 A
6,124,555 A * 9/2000 Isikawa ..... 200/4
6,262,381 B1 * 7/2001 Kikuchi et al. ..... 200/6 A
6,344,618 B1 * 2/2002 Sato ..... 200/6 A
6,344,619 B1 * 2/2002 Yamasaki et al. ..... 200/6 A
6,344,620 B1 * 2/2002 Nakamura ..... 200/6 A
6,348,664 B2 * 2/2002 Kozuma ..... 200/6 A
6,353,430 B2 * 3/2002 Cheng et al. ..... 345/161

* cited by examiner

*Primary Examiner*—Renee Luebke
*Assistant Examiner*—Lisa N Klaus
(74) *Attorney, Agent, or Firm*—McDermott, Will & Emery

(57) ABSTRACT

A multiple operation switch that provides electric signal in accordance with the angle of tilting an operating rod protruding from the front panel of an electronic apparatus. The switch comprises a lower case provided at the recessed bottom with a lower switching portion formed of a movable contact and a first fixed contact point. A movable contact body is provided with a conductive flange that makes contact, when tilted by the operating rod, in part with at least two of the second fixed contact points disposed on the reverse surface of upper case. Which movable contact body is supported at the conductive flange by a holding member pushed upward by a coil spring provided in the lower case so that it is engaged in a tiltable manner with an upper case. The second fixed contact points and the conductive flange constitute an upper switching portion.

19 Claims, 13 Drawing Sheets

MULTIPLE-OPERATION SWITCH

FIELD OF THE INVENTION

The present invention relates to a multiple-way operation switch having an operating rod protruding from the front panel, which switch providing electric signals in accordance with direction of tilting the operating rod. An electronic apparatus incorporating the multiple-way operation switch is also included in the invention.

BACKGROUND OF THE INVENTION

A conventional multiple-way operation switch is described below with reference to FIG. 11, a cross sectional view.

As shown in FIG. 11, a lower case 1 of an octagonal appearance made with an insulating resin is provided at the upper opening with a depression 1A of octagon shape that substantially corresponds to the octagonal appearance, and a first fixed contact point 4 formed of a central fixed contact point 2 and an outer fixed contact point 3 at the bottom. The central fixed contact point 2 and the outer fixed contact point 3 are electrically connected, respectively, with external terminals 2A and 3A projecting from the lower case 1.

A movable contact 5 of round dome shape made of thin conductive metal plate is placed on the outer fixed contact point 3, making direct contact thereon at the bottom of outer edge 5A.

An upper case 6 of octagonal appearance made with an insulating resin, which case couples with the opening of lower case 1, has a round through hole 6A at the center, and is provided on the bottom surface with eight fixed contact points 7A–7H disposed at an equal distance from the center of the through hole 6A with an equal spacing to each other, as shown in a rear view FIG. 12. Each of the respective fixed contact points 7A–7H is electrically led outside of the upper case 6 to terminals 7I–7P.

Referring to FIG. 13 and FIG. 14, a cylindrical member 8 made of an insulating resin is provided with a through hole 9, formed of a round hole 9A in the upper part and an oblong hole 9B in the lower part. In the middle part of the cylindrical member 8, a conductive flange 10 of octagon shape is provided fixed by an insertion molding, which flange shape being slightly smaller than that of the depression 1A of lower case 1. The cylindrical member 8 and the conductive flange 10 constitute a movable contact body 11.

The movable contact body 11 is inserted and engaged at its upper 10 cylindrical portion 8A of the cylindrical member 8 with the through hole 6A of the upper case 6, and pushed upward by a conductive coil spring 12, housed in the lower case 1, with the upper end of the coil spring 12 making direct contact with the bottom surface of the conductive flange 10. Thus the movable contact body 11 is supported to be able to make tilting motion.

Namely, in a normal state as shown in FIG. 11, the movable contact body 11 is being pushed upward by the coil spring 12, and the upper surface of the conductive flange 10 is in contact with the fixed contact points 7A–7H of the upper case 6, maintaining the neutral position.

The contact points 7B–7D, 7F–7H are not shown in FIG. 11.

The bottom end of the conductive coil spring 12 is always in contact with the outer fixed contact point 3; as the result, the contact points 7A–7H are in electrical connection with the outer fixed contact point 3 by way of the conductive flange 10 and the conductive coil spring 12. So, the terminals 7I–7P and the terminal 3A are also in electrical connection.

The terminals 7J–7L, 7N–7P are not shown in FIG. 11.

An operating rod 13 of round rod shape is penetrating through the through hole 9 of the cylindrical member 8 of the movable contact body 11. The operating rod 13 makes contact at the bottom end 13A with the movable contact 5 at the top point 5B.

The operating rod 13 is provided on the outer circumference in the middle portion with an oblong round portion 13B, which is engaged with the oblong hole 9B of the through hole 9 of cylindrical member 8. In this way, the operating rod 13 is supported by the movable contact point body 11 so that it an move up/down for a certain distance, while no revolving is allowed to each other.

A portion of the operating rod 13 protruding out of the upper case 6 is an operating section 13C. In a normal state where there is no operating force exerted, the movable contact body 11 is pushed upward by the coil spring 12 to be in the neutral position; therefore, the operating rod 13 engaged with the through hole 9 is also held at the neutral position.

Now in the following, operation of the above-configured conventional multiple-way operation switch is described.

As already described, in the normal state where there is no operating force exerted to the operating section 13C of the operating rod 13, both the operating rod 13 and the movable contact body 11 are in neutral position, and the upper surface of the conductive flange 10 of the movable contact body 11 is in contact with the fixed contact points 7A–7H provided in the upper case 6.

When an operating force is exerted to the operating section 13C of operating rod 13 in the direction of left, as shown with an arrow mark in FIG. 15, to tilt the operating rod 13 towards the location where fixed contact point 7E is disposed, the operating rod 13 as well as the movable contact body 11 holding it tilt to compress at the left bottom surface of the conductive flange 10 the left portion of the coil spring 12, with the point where the upper surface of the conductive flange 10 at the right, or at a side opposite to the direction indicated with the arrow mark, and the fixed contact point 7A are making contact as the fulcrum point.

In this state, the fixed contact point 7A locating at the place of fulcrum point keeps contact with the conductive flange 10, while the fixed contact point 7E shown in FIG. 15, and the fixed contact points 7B–7D, 7F–7H (not shown) are separated from the conductive flange 10. These fixed contact points 7B 7H are electrically isolated to be in OFF state.

Tilting of operating rod 13 results in lowering of the bottom end 13A, which pushes the top point 5B of movable contact 5 disposed in the lower case 1. The dome shape of the movable contact 5 is reversed, and the outer fixed contact point 3 and the central fixed contact point 2 are electrically connected by the movable contact 5.

In the above state, the terminal 7I of fixed contact point 7A, the terminal 3A of outer fixed contact point 3 and the terminal 2A of central contact point 2 are electrically connected, while other terminals 7J–7P stay in OFF state.

When the operating rod 13 is tilted to other directions, namely to the directions of respective fixed contact points 7A–7D, 7F–7H, the switch operates in almost the same manner as described in the above. A short description of the operation in such cases is given below.

The movable contact body 11 tilts around a fulcrum point at which one of the fixed contact points 7B–7H disposed in a location opposite to the tilting direction of the operating rod 13 makes contact with the conductive flange 10, only one fixed contact point locating at the fulcrum point among those fixed contact points 7B–7H remains in electrical conduction while the other contact points leave to OFF state. The movable contact 5 is pushed as a result of lowering of the operating rod 13 caused by the tilting operation, and the dome shape is reversed, bringing the outer fixed contact point 3 and the central fixed contact point 2 into electrical conduction via movable contact 5. The state of electrical connection among the fixed contact points 7A–7H, the central fixed contact point 2 and the outer fixed contact point 3 are delivered outside through respective terminals 7I–7P, 2A and 3A.

As soon as the tilting force exerted on the operating rod 13 is withdrawn, the coil spring 12 and the movable contact 5 are restored respectively to the initial shape, the elastic restorative force of these items pushes the movable contact body 11 and the operating rod 13 upward setting them to the normal stand as shown FIG. 11.

In other case when the operating section 13C of operation rod 13 is pushed vertically down while it is in the normal state as shown in FIG. 11, only the operating rod 13, which is coupled with the cylindrical member 8 through the through hole 9 so that it can slide up and down, moves down to push at the bottom end 13A the top point 5B of movable contact 5. The movable contact 5 is reversed in the shape, while the movable contact body 11 is maintained at the normal position being supported by the upward pushing force of the coil spring 12. The reversed movable contact 5 brings the outer fixed contact point 3 and the central contact point 2 into electrical contact. This state is shown in FIG. 16.

In the above described state, where the outer fixed contact point 3 and the central fixed contact point 2 have been brought to ON state by the pressing operation, the fixed contact points 7A–7H, which are electrically connected with the outer fixed contact point 3 via the conductive flange 10 and the coil spring 12, are connected also with the central fixed contact point 2. Thus, all of the terminals 7I–7P, 2A and 3A are in electrical connection.

As soon as the pushing force given on the operating rod 13 is withdrawn, the movable contact 5 is restored to the initial dome shape, the restorative force of which pushes the operating rod 13 up to the normal stand as shown FIG. 11.

However, the above-described conventional multiple-way operation switch, which comprises an upper switching portion formed of the fixed contact points 7A–7H and the conductive flange 10 and a lower switching portion formed of the movable contact 5, the outer fixed contact point 3 and the central fixed contact point 2, and can change the state of contact in both the upper switching portion and the lower switching portion by a certain specific operating action exerted on the operating rod 13, harbors certain drawbacks. With respect to the upper switching portion, among others, when the operating rod 13 is accidentally tilted even for a slightest amount it easily separates the conductive flange 10 from the fixed contact points 7A–7H, bringing either one of the fixed contact points 7A–7H into OFF state. In the conventional multiple-way operation switch, the state of contact can be changed in the upper switching portion and in the lower switching portion by a tilting action of the operating rod 13; however, there is other drawback that since the switching in the upper switching portion and the lower switching portion take place almost at the same timing scope of application is limited. Namely, the conventional switch can not be used in such applications where two kinds of switch signals generated with a certain time lag are needed; for example, a case where a selection signal is needed for selecting a desired menu among a number of menus and then another signal is needed for fixing and entering the selected menu.

The present invention addresses these drawbacks with the conventional multiple-way operation switches, and aims to offer a multiple-way operation switch provided with superior operational functions, with which switch the state of upper switch portion dose not easily shift even if operating rod is slightly tilted by a careless action of an operator, state of contact in the upper switching portion alone can be changed by manipulating the operating rod within a certain specific small angle, and by tilting the operating rod a step further the state of contact in the lower switching portion is changed keeping the state of the upper switching portion as it is.

SUMMARY OF THE INVENTION

A multiple-way operation switch of the present invention comprises a lower case provided at the recessed bottom with a lower switching portion formed of a first fixed contact point and a movable contact making on/off contact with the fixed contact point, an operating rod supported at the center of the upper opening of the lower case so that it can slide up and down for pushing down the movable contact of the lower switching portion, and a movable contact body provided with a conductive flange at the outer periphery, which flange being held with immediate contact on a holding member which is pushed upward by pressing force of a press member provided in the lower case while an upper spherical portion of the movable contact body is pressed upward by the pressing force to be coupled with a spherical wall of an upper case so that the movable contact body can tilt. When the movable contact body is tilted as a result of tilting operation exerted to the operating rod, the flange of movable contact body makes contact in part with at least two of a plurality of second contact points provided on the reverse surface of the upper case; this constitute an upper switching portion.

The above-configured multiple-way operation switch offers superior operational functions. When the operating rod is tilted for a certain specific angle, part of the conductive flange of movable contact body makes contact with certain specific contact points among the second fixed contact points disposed in the upper case; thus the state of contact at the upper switching portion is changed while the state of lower switching portion is kept unchanged. When the operating rod is tilted further for a greater angle, the movable contact body tilts a step more with the point of contact as the fulcrum, and the lowering bottom end of the operating rod pushes the lower switching portion down to change the state of connection.

DESCRIPTION OF PREFERRED EMBODIMENTS

Exemplary embodiments of multiple-way operation switch of the present invention are described in the following with reference to the drawings.

First Embodiment

Figure 1:
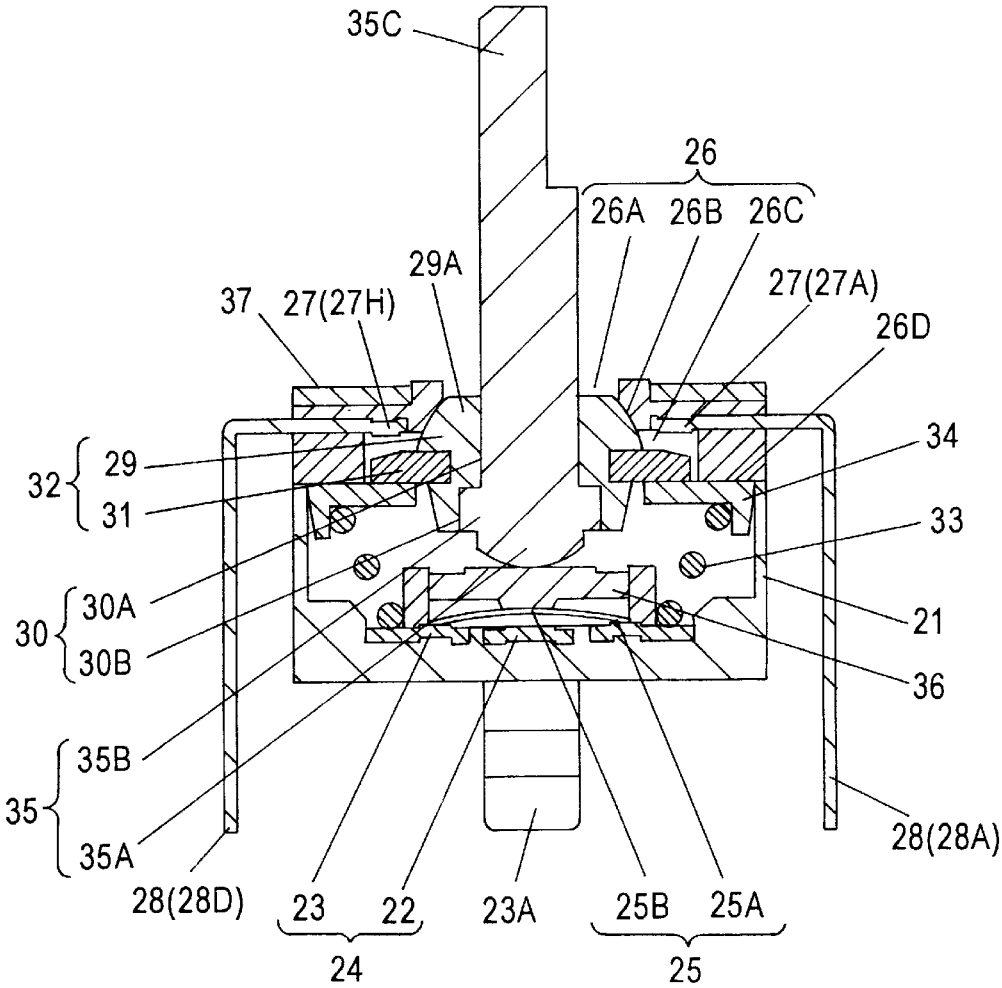
FIG. 1 is a cross sectional view of a multiple-way operation switch in accordance with a first exemplary embodiment of the present invention.
Figure 2:
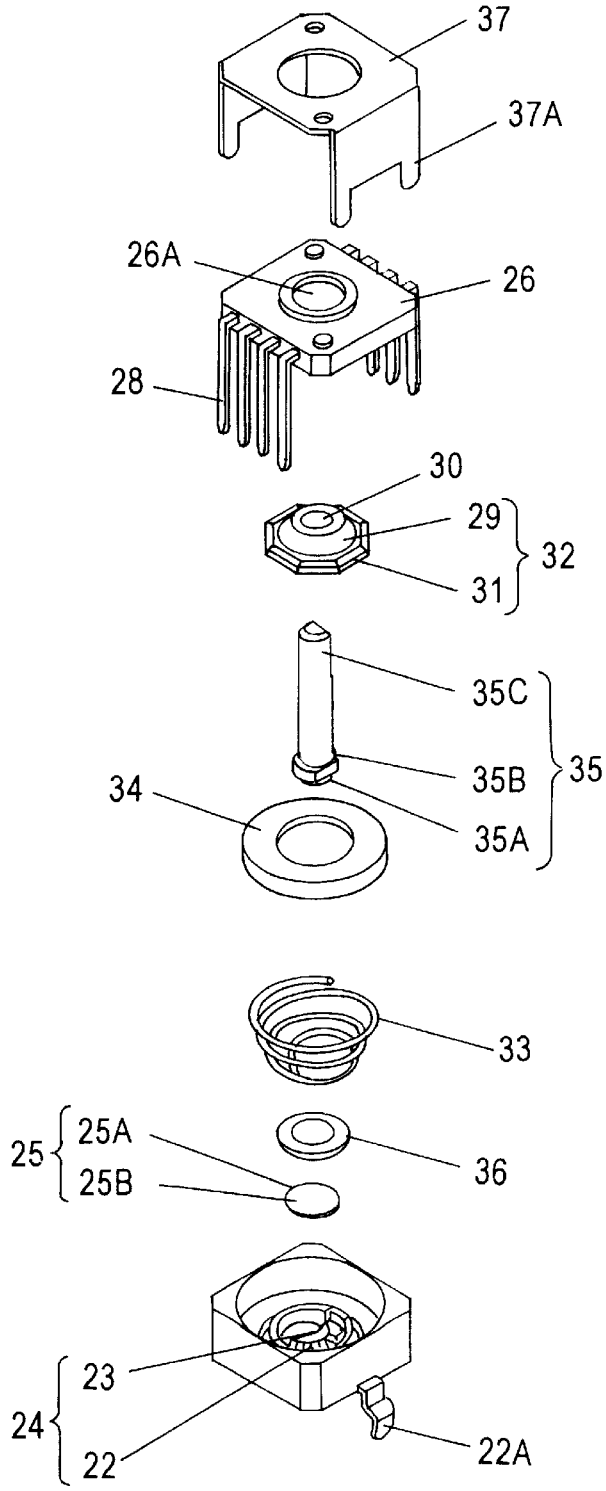
FIG. 2 is an exploded perspective view of the multiple-way operation switch.

FIG. 1 is a cross sectional view of a multiple-way operation switch in a first exemplary embodiment of the present invention, FIG. 2 is an exploded perspective view of the multiple-way operation switch. An open-end lower case 21 made of an insulating resin having a recessed area at the bottom is provided at the bottom of the recessed area with a first fixed contact point 24 formed of a central fixed contact point 22 and an outer fixed contact point 23, and a terminal 22A and a terminal 23A electrically connected with the central fixed contact point 22 and the outer fixed contact point 23, respectively, are led to the outside.

Provided on the outer fixed contact point 23 is a round dome shape movable contact 25 made of a conductive thin metal plate, the lower edge 25A of outer periphery making contact thereon.

Covering the upper opening of lower case 21 is an upper case 26 made of an insulating resin, which upper case having a round hole portion 26A at the center and a second fixed contact points 27 on the reverse surface.

The upper case 26 is provided with a spherical wall 26B on the reverse surface of edge area of the round hole portion 26A, and a recess 26C of octagon shape that is open towards bottom. On the surface exposed in the recess 26C, there are 16 pcs. of second fixed contact points 27.

The round hole portion 26A and the recess 26C in the upper case 26 share a center in common.

Figure 3:
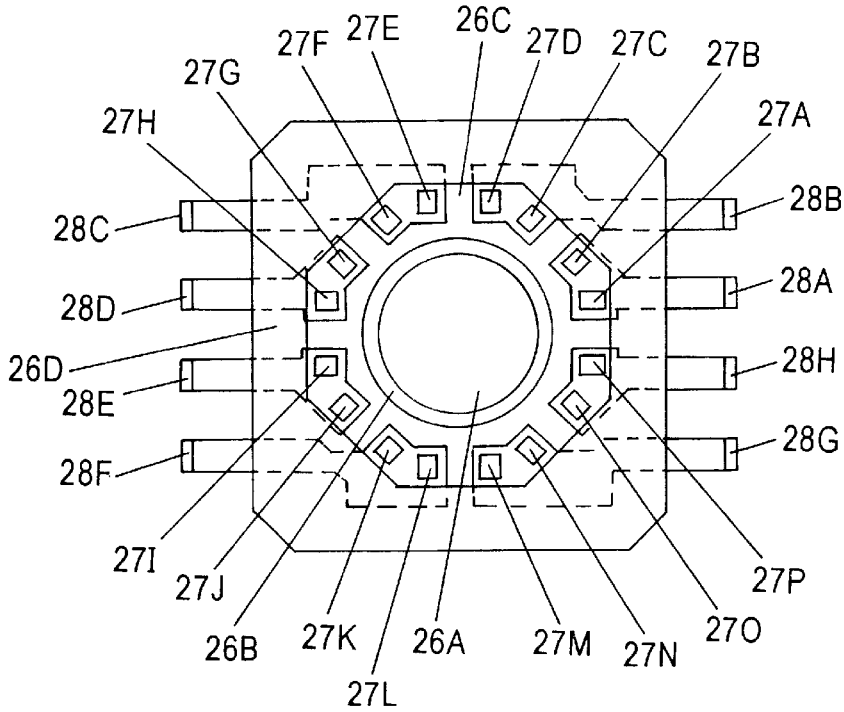
FIG. 3 shows rear view of the upper case, which being a key portion, of the multiple-way operation switch.

The 16 pcs. of second fixed contact points 27 (27A–27P) are disposed in the octagon recess 26C so that there are 2 pcs. of the fixed contact points in each of the sides, at a same distance from the center of the round hole portion 26A, as shown in the rear view of upper case 26, FIG. 3.

As shown in FIG. 3, the upper case 26 is provided with 8 pcs. of external terminals 28 (28A–28H) electrically isolated to each other. Each of the respective terminals 28A–28H is electrically connected with two fixed contact points, among the second fixed contact points 27. (27A–27P), locating next to each other with a corner of the octagon in between.

Figure 4:
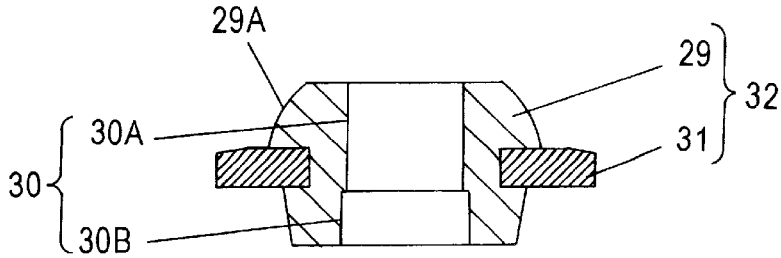
FIG. 4 is a cross sectional view of the movable contact body, which being a key portion, of the multiple-way operation switch.
Figure 5:
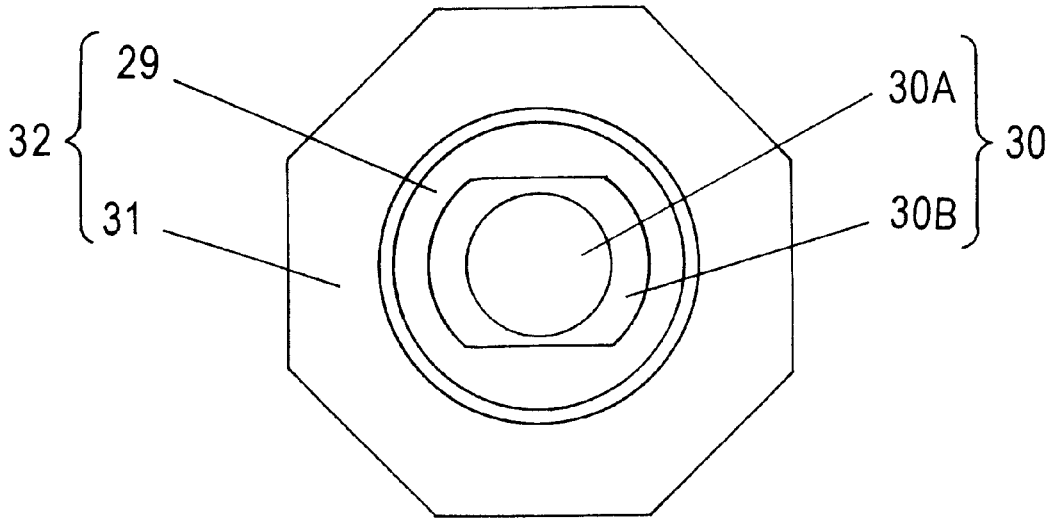
FIG. 5 shows rear view of the movable contact body, which being a key portion, of the multiple-way operation switch.

As shown in FIG. 4, a cross sectional view, and FIG. 5, a rear view, a cylindrical member 29 made of an insulating resin has a through hole 30, which hole is consisting of a round hole 30A in the upper part and an oval hole 30B in the lower part, and is provided with a conductive flange 31 of octagon shape which is smaller by some extent than that of the recess 26C. The conductive flange 31 is formed and attached to the middle of outer periphery by an insert formation process. The cylindrical member 29 and the flange 31 constitute a movable contact body 32.

The cylindrical member 29 is provided with an upper spherical portion 29A, whose outer surface has been processed to assume a spherical shape of the same diameter as the spherical wall 26B.

The cylindrical member 29 and the flange 31 may be formed integrally as a single unit member with a conductive material.

A coil spring 33, which is an elastic member made of a conductive material and which is also referred to as a pressure member, is mounted within the lower case 21 making electrical connection at the bottom end with the outer fixed contact point 23. The upper end of the coil spring makes contact with the reverse surface of a holding member 34 made of a conductive material to provide an upward pressure to the holding member 34. The holding member 34 is formed in a ring shape and has a flat top.

The movable contact body 32 is mounted so that the conductive flange 31 is placed on the upper surface of holding member 34 at the inner circumference, and the upper spherical portion 29A of cylindrical member 29 is engaged with the spherical wall 26B of upper case 26.

Namely, the movable contact body 32 is pushed upward at the flange 31 by the holding member 34, which is receiving an upward force from the coil spring 33, and is engaged with the upper case 26 sharing a spherical shape in common at the joints. Therefore, the movable contact body 32 stays at horizontal stance.

The horizontal stance of the holding member 34 can be easily brought to a stability by having the outer periphery area of flat top surface of the holding member 34 to get in touch with the bottom edge 26D of upper case 26, and the upper spherical portion 29A of cylindrical member 29 to get in touch with the spherical wall 26B of upper case 26, as shown in FIG. 1. As the result, the horizontal stance of the movable contact body 32 is stabilized, too.

In this state, the flange 31 is housed inside the recess 26C of the upper case 26. Since both the recess 26C and the flange 31 have been formed in octagon shape, revolving motion of the movable contact body 32 relative to the recess 26C of upper case 26 is prevented.

Operating rod 35 is attached to the movable contact body 32 penetrating through the through hole 30; an operating section 35C, or the upper part of operating rod 35 is extruding from the hole portion 26A of upper case 26, while the spherically-formed bottom end 35A makes contact on the upper surface of an insulating push member 36 placed on the top point 25B of movable contact 25.

The operating rod 35 is provided in the middle of the outer surface with an oval section 35B to be coupled with the oval hole 30B of the through hole 30 of cylindrical member 29. In this way, the operating rod 35 is supported so that it does not revolve relative to the movable contact body 32, while it can travel up and down for a certain specific distance.

Since the movable contact body 32 supporting the operating rod 35 is normally held at the horizontal stance, the operating rod 35 supported by the cylindrical member 29 of the movable contact body 32 stays at the upright neutral position when there is no operating force exerted to the operating rod 35.

The upper case 26 and the lower case 21 are coupled together by a metal cover 37 applied from above the upper case 26, whose feet 37A are bent tight against the bottom of the lower case 21.

Instead of employing a metal cover 37, the upper case 26 and the lower case 21 may be attached directly together by using a thermal welding process, doweling or other such process.

Now in the following, the operation of a multiple-way operation switch configured above is described.

Referring to FIG. 1, when the operating rod 35 is free of any operating force, the operating rod, which is supported by the movable contact body 32, keeps standing at the neutral position, and the flange 31 of movable contact body 32 stays horizontal. Therefore, each of the second fixed contact points 27 (27A–27P) stays electrically isolated, or in OFF state.

Since there is no downward shift with the operating rod 35, the first fixed contact point 24 also stays in OFF state.

Figure 6:
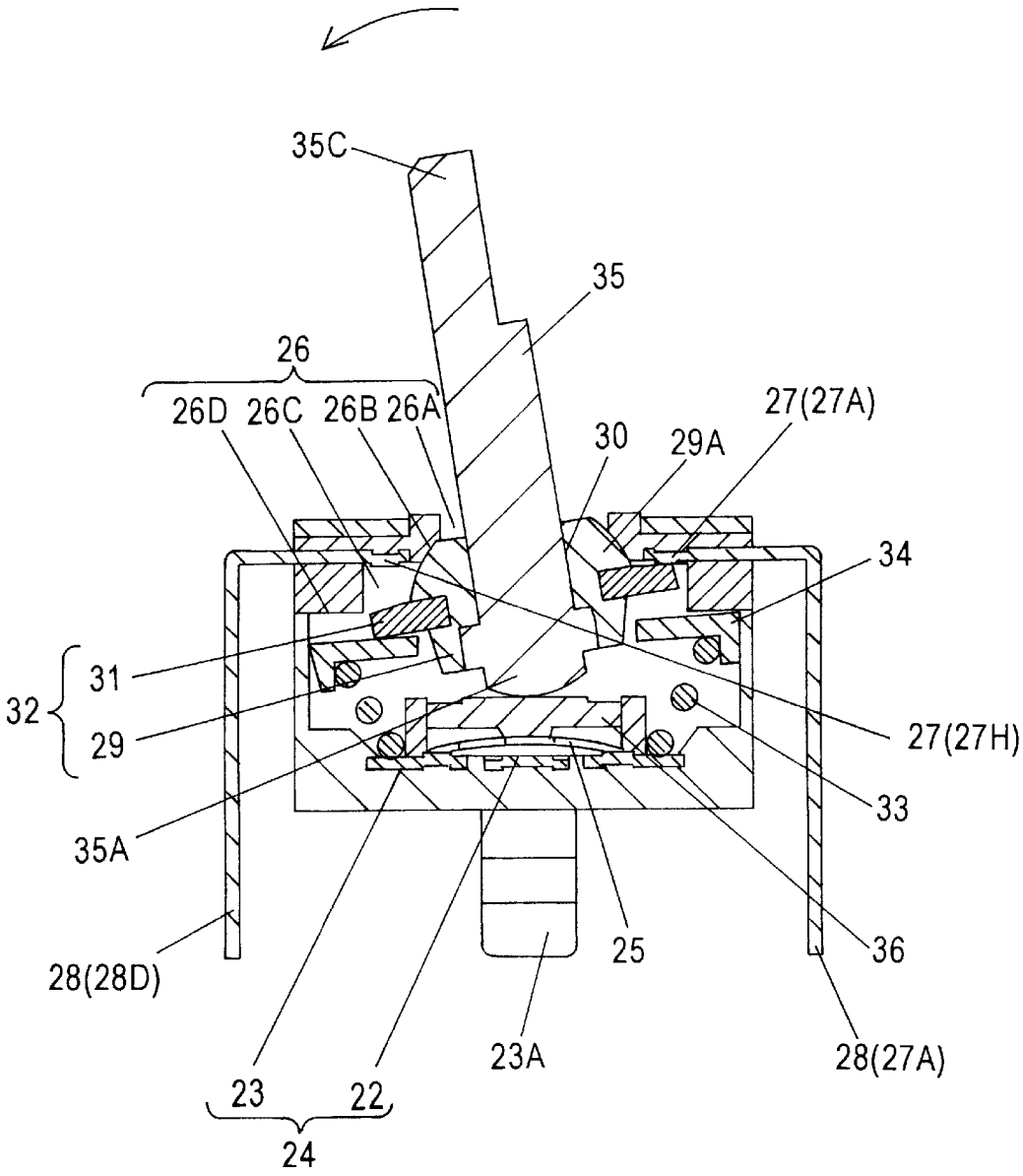
FIG. 6 is a cross sectional view used to describe a state when the operating rod is tilted in the multiple-way operation switch.

When an operating force is exerted to the operating section 35C of operating rod 35 for tilting it to the left, as indicated with an arrow mark in FIG. 6, the movable contact body 32 holding the operating rod 35 also tilts in combination with the tilt motion of operating rod 35, pushing the holding member 34 downward with the left bottom part of the flange 31, compressing the coil spring 33 in the left part.

The holding member 34 in the right part, or a part opposite to the direction of tilt operation, is free from direct influence of the downward pressing force and is being pushed upward from the bottom by the coil spring 33. Therefore, the holding member 34 tilts left, maintaining the contact of upper surface in the right with the bottom edge 26D of side wall portion of upper case 26.

The movable contact body 32 can tilt smoothly to the left, because it makes contact at the upper spherical portion 29A with the spherical wall 26B of the upper case 26, and the operating rod 35 penetrating through the through hole 30 is shaped spherical at the bottom end 35A.

When the movable contact body 32 is tilted to a certain specific angle as shown in FIG. 6, the upper surface of the flange 31 in the right part, or a part opposite to the direction of tilting, comes into contact with one of the sides of the recess 26C of upper case 26 bringing the second fixed contact point 27A and the second fixed contact point 27P, both contact points locating in the same above-described side of the recess as shown in FIG. 3, into electrical conduction; as the result, the terminal 28A and the terminal 28H are also brought into electrical conduction.

Since the flange 31 is electrically connected also with the outer fixed contact point 23 via the conductive holding member 34 and the coil spring 33, the terminal 23A connected to the outer fixed contact point 23 is also brought into the connection, besides the terminal 28A and the terminal 28H.

In this way, the operating rod 35 and the movable contact body 32 are tilted around a fulcrum point locating at approximately the center of the movable contact body 32, and certain specific contact points among the second fixed contact points 27 locating at a side opposite to the direction of tilting, disposed in the upper case 26, are brought into a state of the electrical conduction by the flange 31.

As described earlier, the movable contact body 32 as well as the operating rod 35 in the present state are held so that they can not make any revolving motion relative to the upper case 26. Therefore, certain specific contact points among the second fixed contact points 27 can be brought into a stable mutual connection state by a tilting operation exerted to the operating rod 35.

The flange 31 of movable contact body 32 is positioned at a place where it does not make casual contact with the second fixed contact points 27 when the operating rod 35 is tilted only slightly by mistake. Therefore, the electrical connection, or disconnection, among the second fixed contact points 27 does not take place unless the operating rod 35 is manipulated to a certain specific operation angle.

Since the center of tilting motion of the operating rod 35 and the point where the bottom end 35A of operating rod 35 makes contact with the push member 36 are on the same axis line, as seen also from FIG. 1, distance of downward shift of the operating rod 35 as a result of the tilting is limited. Therefore, the first fixed contact point 24 can remain at OFF state.

Figure 7:
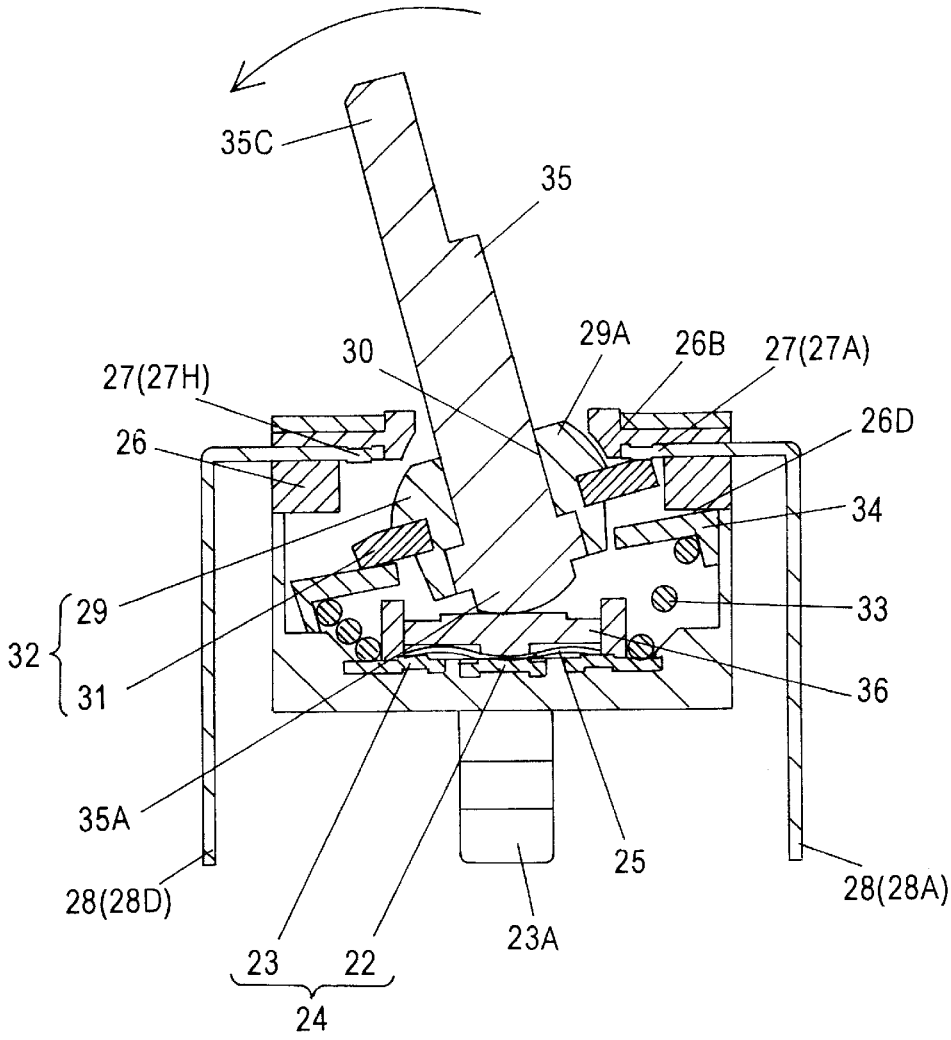
FIG. 7 is a cross sectional view used to describe a state when the operating rod is tilted in the multiple-way operation switch.
Figure 8:
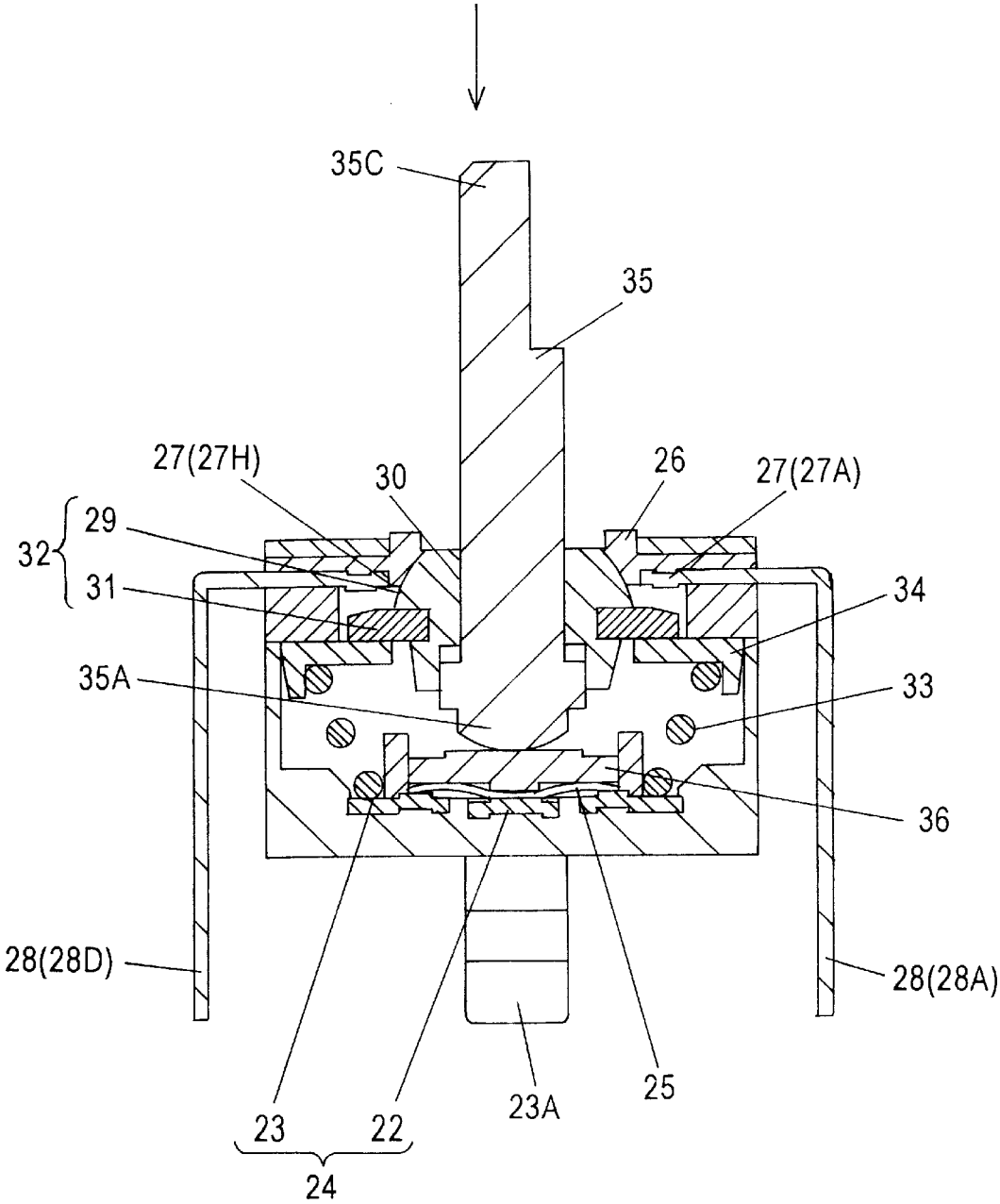
FIG. 8 is a cross sectional view used to describe a state when the operating rod is pushed downward in the multiple-way operation switch.

When the operating rod 35 is tilted a step further to the left from the state of FIG. 6, the operating rod 35 and the movable contact body 32 tilt further pushing the holding member 34 down by the bottom surface of the left part of the flange 31 with the point of contact where the right end of the flange 31 makes contact with the second fixed contact point 27A and the second fixed contact point 27P as the fulcrum, which state is illustrated in the cross sectional view FIG. 7.

In this state, the bottom end 35A of operating rod 35 travels downward for a substantial amount, as a result, the movable contact 25 is pushed by the push member 36, as soon as the pushing force goes beyond a certain limit the dome shape of movable contact 25 reverses to make contact with the central fixed contact point 22 at the bottom surface. Thus the central fixed contact point 22 and the outer fixed contact point 23, or the first fixed contact point 24, are brought into a state of electrical connection by the movable contact 25.

In the course of the above tilting operation, a feeling of stepping is generated by the movable contact 25. And a terminal 22A, not shown, and a terminal 23A are brought into electrical connection.

In a state where the operating rod 35 is tilted to the leftmost, as illustrated in FIG. 7, the operating rod 35 and the movable contact body 32 are tilted around the fulcrum point, which was shifted to the outer edge of the flange 31. Therefore, it may be considered that there is a possibility for the movable contact body 32 to slide to the left oblique downward, with the upper spherical portion 29A of movable contact body 32 departing from the spherical wall 26B of upper case 26. The occurrence of such a possible departure, however, can be prevented by providing simple position regulation means, which could be a combination of a protrusion and a dent for engagement provided in the movable contact body 32 and the holding member 34, respectively.

In a case where the bottom end 35A of operating rod 35 pushes the movable contact 25 at a point off the center, the push member 36 interposing between the operating rod 35 and the movable contact 25 conveys the pushing force vertically down on the movable contact 25. Therefore, even in such a case, generation of a clear feeling of stepping and a reliable electrical contact in the first fixed contact point 24 are assured.

In the state as illustrated in FIG. 7, the flange 31 of movable contact body 32 is in contact with both the second fixed contact point 27A and the second fixed contact point 27P, not shown; accordingly, the respective terminal 28A and terminal 28H are in electrical connection. Furthermore, since the flange 31 is electrically connected with the outer fixed contact point 23 via the coil spring 33, the four terminals 22A, 23A, 28A and 28H are in the state of electrical connection among each other.

Namely, in the above case, the operating rod 35 and the movable contact body 32 continue the tilting motion with a point of contact where the flange 31 makes contact with certain specific second fixed contact points 27 as the fulcrum, while maintaining the electrically ON, or OFF, state with the upper switching portion; in the subsequent stage they bring the first fixed contact point 24 into ON state.

As soon as the operating rod 35 is released from the tilting force, the operating rod 35 and the movable contact body 32 are restored to the initial normal stance by the elastic force of the movable contact 25 and the coil spring 33; where the first fixed contact point 24 and each of the second fixed contact points 27 are electrically isolated to each other, as shown in FIG. 1.

As described in the above, in a multiple-way operation switch in accordance with the present embodiment, both of the switching portions, namely, an upper switching portion formed of the flange 31 and the second fixed contact points 27 disposed in the upper case 26 and a lower switching portion formed of the first fixed contact point 24 disposed in the lower case 21 and the movable contact 25, are in OFF state in the normal state. When the operating rod 35 is tilted to a certain specific angle, certain specific contact points in the upper switching portion are brought into conduction state, and then, the lower switching portion can be brought into conduction state by further tilting the operating rod 35 for a certain angle.

In the normal state as illustrated in FIG. 1, when the operating section 35C of operating rod 35 is pushed vertically downward, the operating rod 35 penetrating through the through hole 30 of movable contact body 32 so that it can slide up and down goes downward, and the bottom end 35A pushes to reverse the movable contact 25 via the push member 36. The first fixed contact point 24 is thus brought into electrical connection via the movable contact 25.

Under the above-described situation, the movable contact body 32 and the holding member 34 are being pushed upward by the coil spring 33 and are held horizontal. The flange 31 of movable contact body 32 makes contact with neither one of the second fixed contact points 27. Thus, the entire upper switching portion stays at OFF state, while the lower switching portion alone is at ON state.

As soon as the operating rod 35 is released from the downward pushing force, the movable contact 25 restores the initial shape bringing the lower switching portion into OFF state, and the elastic restorative force pushes the push member 36 as well as the operating rod 35 upward to the normal state as shown in FIG. 1.

In a multiple-way operation switch of the present embodiment, the state of the upper switching portion and the lower switching portion can be changed by tilting or pressing the operating rod 35. By the tilting operation, among other operation, the state of the lower switching portion can be easily changed by simply changing the tilting angle of operating rod 35, maintaining certain specific contact points of the upper switching portion at ON state. Thus the present invention offers a multiple-way operation switch that is simple in structure yet provides superior operational functions.

With a multiple-way operation switch having a structure in which certain specific contact points of the second fixed contact points 27 can be brought to the same potential as the outer fixed contact point 23, the circuit structure of an electronic apparatus incorporating the multiple-way operation switch may be made simpler by holding the outer fixed contact point 23 at common potential.

In a multiple-way operation switch of the present embodiment, the operating rod 35 has been held insulated from the upper switching portion as well as from the lower switching portion. As the result, a possible influence by an electrostatic or other factors coming through the operating rod 35 can be readily reduced.

In a multiple-way operation switch of the present embodiment, the upper switching portion and the lower switching portion may be made electrically separated to each other, by constituting the coil spring 33, or the holding member 34, with an insulating material, or by electrically isolating the coil spring 33 from the outer fixed contact point 23.

Although the present exemplary multiple-operation switch is described with an operating rod 35 can be tilted in eight directions, the present invention may of course be implemented into a multiple-operation switch where the operating rod 35 tilts, for example, in four directions, besides eight directions.

Second Embodiment

A second exemplary embodiment of the present invention is described below. The present embodiment 2 relates to an electronic apparatus which is incorporating a multiple-way operation switch of embodiment 1.

Figure 9:
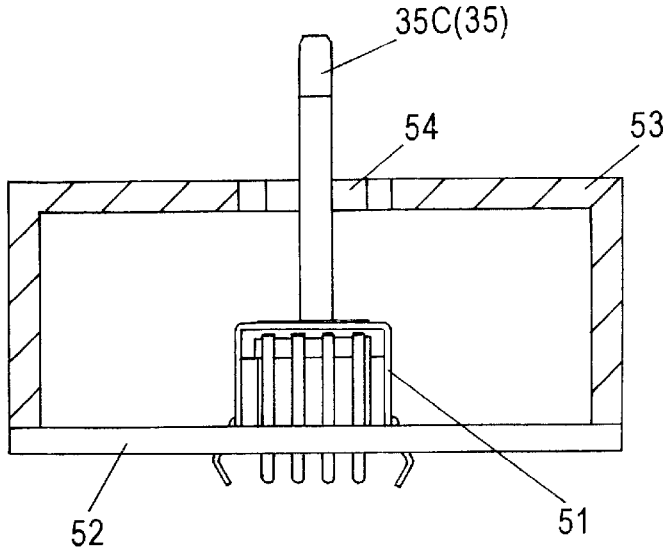
FIG. 9 is a conceptual illustration of an electronic apparatus in accordance with a second exemplary embodiment of the present invention.
Figure 10:
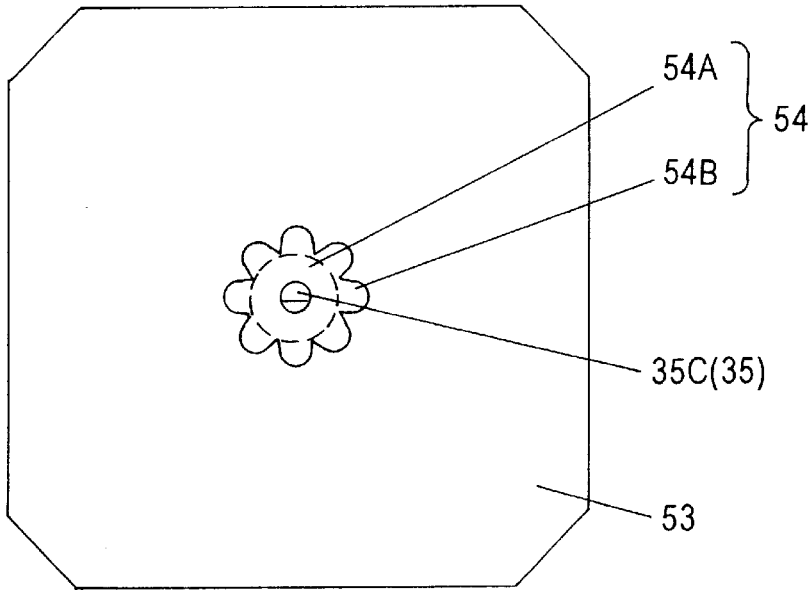
FIG. 10 is a top view of the electronic apparatus.
Figure 11:
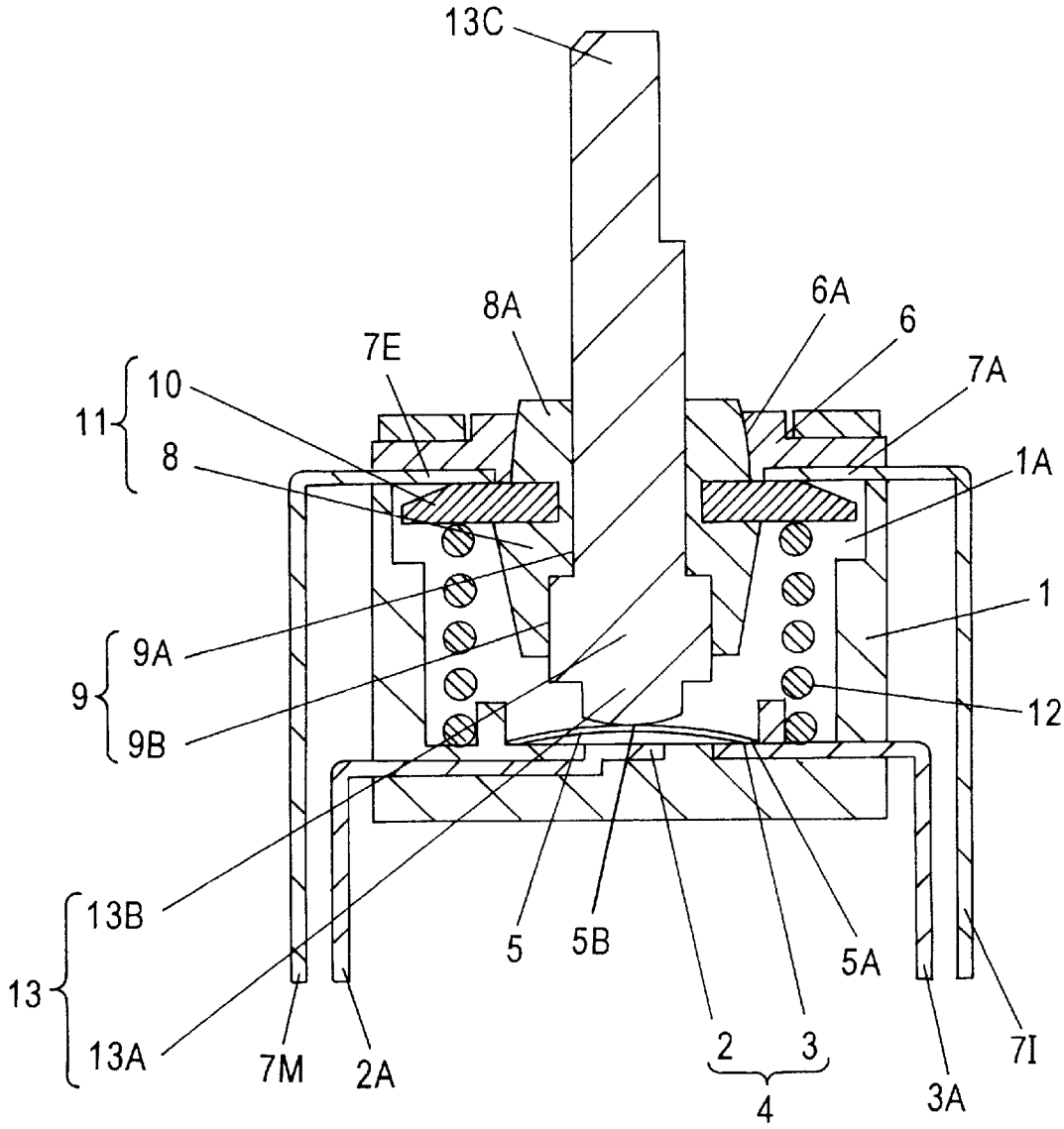
FIG. 11 is a cross sectional view of a conventional multiple-way operation switch.
Figure 12:
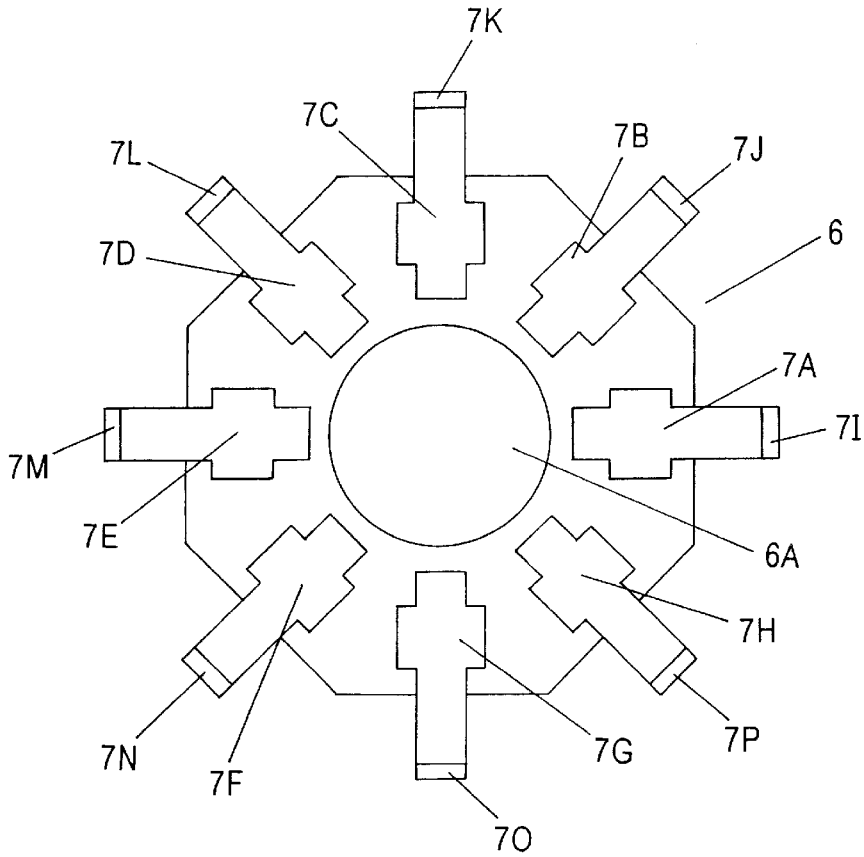
FIG. 12 shows rear view of an upper case, which being a key portion, of conventional multiple-way operation switch.
Figure 13:
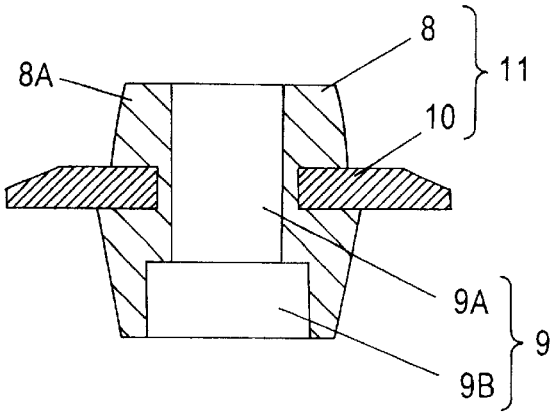
FIG. 13 is a cross sectional view of a movable contact body, which being a key portion, of conventional multiple-way operation switch.
Figure 14:
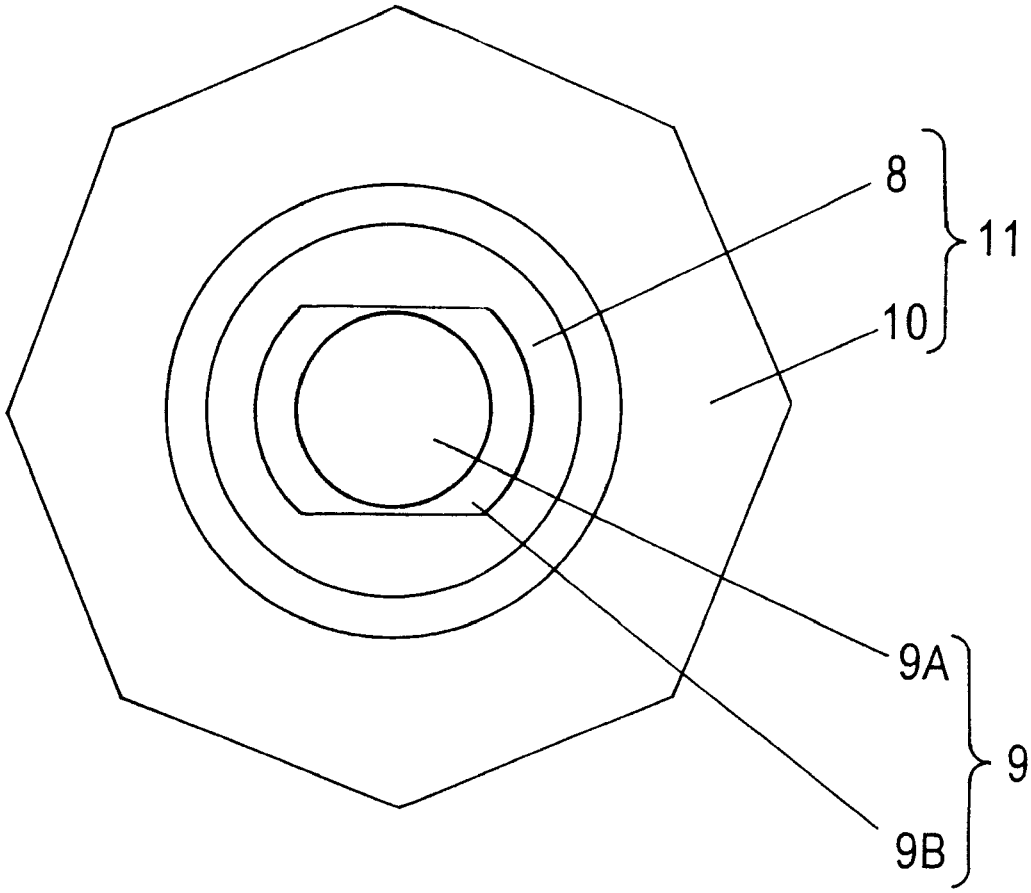
FIG. 14 shows rear view of conventional multiple-way operation switch.
Figure 15:
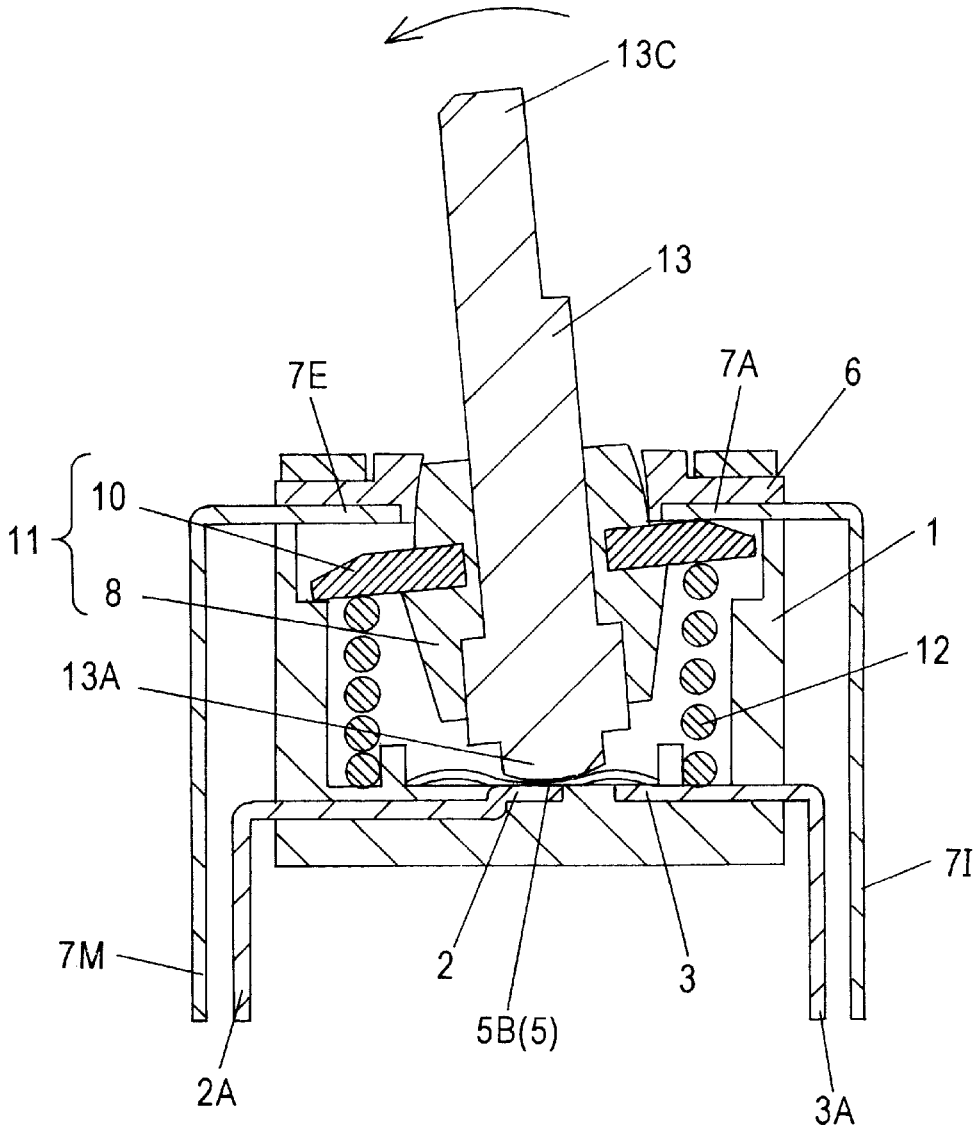
FIG. 15 is a cross sectional view used to describe a state when an operating rod is tilted, in conventional multiple-way operation switch.
Figure 16:
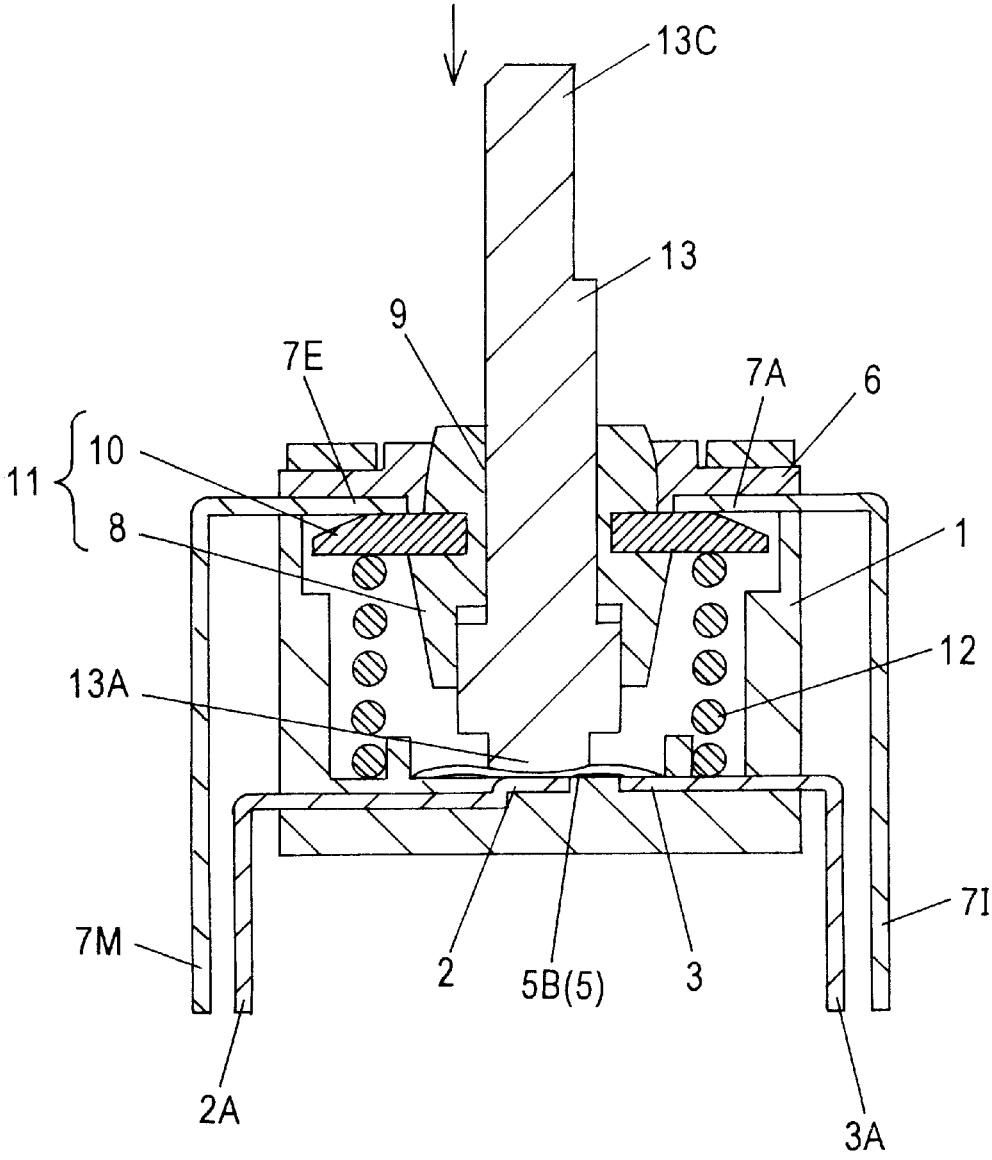
FIG. 16 is a cross sectional view used to describe a state when an operating rod is pushed downward, in conventional multiple-way operation switch.

FIG. 9 illustrates concept of an electronic apparatus in accordance with embodiment 2, FIG. 10 is the top view.

As shown in FIG. 9, a multiple-way operation switch 51 of embodiment 1 is mounted on a circuit board 52 of an electronic apparatus; operating section 35C of operating rod 35 is extruding through a through hole 54 of an outer casing 53.

The through hole 54 of the outer casing 53 has a shape as shown in FIG. 10; cuts 54 are provided in radial directions around a round hole 54A.

Direction of the cuts 54B corresponds to a direction where the state of switching connection in the upper switching portion in the multiple-way operation switch 51 shifts when the operating rod 35 is tilted.

In the above-configured electronic apparatus, the operating rod 35 is tilted for a certain angle so that it comes close to the circular edge area of round hole 54A for changing the connection state in the upper switching portion of multiple-way operation switch 51; an output signal then generated at the multiple-way operation switch 51 is used for putting a certain specific function into operation. And then, the operating rod 35 is further tilted so that it proceeds into the cut 54B provided in radial direction for changing the connection state in the lower switching portion of multiple-way operation switch 51; an output signal then generated at the multiple-way operation switch 51 is used for putting a certain specific function other than the above-described specific function into operation.

An electronic apparatus of the present embodiment may be used in such applications, for example: Suppose there is a display screen in which pluralities of display items, icons, etc. are involved, the operating rod 35 is tilted to the vicinity of circular edge of round hole 54A to put certain contact points of the upper switching portion of the multiple-way operation switch 51 into ON state, and cursor in the display screen is moved by detecting the signal to a location of desired object, and then the selected object is entered by tilting the operating rod 35 further into radial cut 54B to bring the lower switching portion of the multiple-way operation switch 51 into ON state.

If in this exemplary case the operating rod 35 of multiple-way operation switch 51 was casually tilted by mistake to a wrong direction and the cursor was sent away from what is desired, the cursor may be shifted easily to a desired location by moving the operating rod 35 along the circular edge area of round hole 54A of the through hole 54.

In the multiple-way operation switch 51, the state of connection in the lower switching portion can be changed, while maintaining the state of the upper switching portion as it is, by shifting the tilt angle of the operating rod 35. The present electronic apparatus can be held to switch to perform different functions by simply changing the angle of tilting with a single operating rod. The present invention thus offers an electronic apparatus that has superior operational functions.

As described in the above, when the operating rod is tilted in a multiple-way operation switch of the present invention from the neutral position the movable contact body also tilts together with the operating rod around the spherical center of the spherical wall of the upper case supporting the upper spherical portion, and the flange at a side opposite to the direction of tilting makes contact with at least two of the contact points among the plurality of second fixed contact points disposed in the upper case to bring the contact points into ON state. When the operating rod is tilted further to the same direction, the movable contact body continues the tilting maintaining the state of upper switching portion formed of the second fixed contact points and the flange as it is, with the point of contact between the second contact points and the flange as the fulcrum. The movable contact body tilts around the fulcrum point giving compression in part of a pressure member via the holding member, and the lowering bottom end of operating rod pushes the movable contact bringing it to make contact with the first fixed contact point; thus the lower switching portion formed of the movable contact and the first fixed contact point is put into operation. In this way, a multiple-way operation switch of the present invention provides superior operational functions, where respective connection states in the upper switching portion and the lower switching portion can be changed by tilting a single operating rod for different angles.

The operating rod can be insulated with ease in the present multiple-way operation switch, so the electrostatic influence or other such influences that could be introduced through the operating rod to the upper switching portion formed of the second fixed contact points and the conductive flange and the lower switching portion disposed underneath the operating rod formed of the first fixed contact point and the movable contact can be reduced. What is more, even when the operating rod is in the course of the tilting action the lower switching portion can be brought into operation by pushing the movable contact vertically downward with the push member; therefore, a clear feeling of stepping is provided.

Both the upper switching portion and the lower switching portion may be brought into electrical connection with the outer fixed contact point. With such a configuration, the circuit structure of an apparatus employing the multiple-operation switch may be made simpler by holding the outer fixed contact point as the common potential.

Since the spherical bottom end of the operating rod is on the same axial line as the center of tilting of the movable contact body, the amount of downward travel of the operating rod during the tilting operation by a moment when the state of the upper switching portion is changed can be made small and the pressing force given on the movable contact disposed in the lower case is small. Therefore, the lower switching portion can be easily maintained at OFF state.

The movable contact body is surely held by a mechanical engagement between the polygonal shapes and prevented from making revolution, which insures a stable state of contact between the flange of movable contact body and the second fixed contact points of upper case at a certain specific location. Thus, the connection status in the upper switching portion stays stable during manipulation of tilting the operating rod.

Direction of the tilting manipulation is regulated without fail by a simple structure in the present multiple-way operation switch, state of connection in the upper switching portion can be changed by tilting the operating rod for a small angle, and the lower switching portion is changed in the connection state by further tilting the operating rod in the same direction. Therefore, an electronic apparatus having superior operational functions may be implemented by providing radial cuts in a panel in line with the directions of tilting the operating rod; which electronic apparatus offering such functions as, for example, selecting a certain desired function by a signal delivered from the upper switching portion, and entering the selected function with other signal delivered from the lower switching portion.

Since central portion of the through hole having the radial cuts is formed round, the state of connection in the upper switching portion may be shifted by manipulating the operating rod along the round circle; by so doing the operating rod can be held at a certain specific tilt angle appropriate for the objective.

As described in the above, the present electronic apparatus incorporating the multiple-way operation switch provides two functions which are put into operation with time lag by a simple manipulation of tilting the operating rod. Thus it provides a substantial convenience that a certain function can be switched to another function by a simple operating action.

What is claimed is:

1. A multiple-operation switch comprising:

a lower case made of an insulating material having a recess with an open end positioned upwardly, said lower case having a recessed bottom area comprising a first fixed contact point disposed at a center portion thereof;

a movable contact capable of a stepping action, said movable contact disposed in the recessed bottom area of said lower case such that said movable contact is movable between a first position in which said movable contact engages said first fixed contact point and a second position in which said movable contact does not engage said first fixed contact point;

an upper case made of an insulating material for coupling with said lower case, said upper case having a through hole at the center thereof opposing the recessed bottom area of said lower case, said upper case having a bottom surface around the edge of the through hole formed as a spherical wall, said upper case having a plurality of second fixed contact points provided on the bottom surface thereof, said second fixed contact points positioned equidistant from the center of said through hole;

a holding member being forced upwardly by a pressure member provided in said lower case;

a movable contact body having a through hole in the center and provided around an outer periphery of an upper spherical portion with a conductive flange, said flange being disposed on said holding member and pressed upwardly via the holding member by a pressing force of the pressure member so that said upper spherical portion is engaged with the spherical wall of said upper case such that the movable contact body is able to make a tilting motion, and, when it is tilted, the flange makes contact with at least two of said second contact points; and an operating rod penetrating through the through hole of said movable contact body, said operating rod capable of vertical movement.

2. The multiple-operation switch of claim 1, wherein:

the movable contact body is formed of a cylindrical member made of an insulating material provided with a conductive flange fixed thereon, and an insulating push member is interposed between a spherical bottom end of said operating rod and the movable contact.

3. The multiple-operation switch of claim 2, wherein the first fixed contact point disposed in the lower case comprises:

a central fixed contact point and an outer fixed contact point disposed around the central fixed contact point, and a round dome shape movable contact which is disposed on the outer fixed contact point with the bottom circumference edge making contact thereon.

4. An electronic apparatus incorporating the multiple-operation switch recited in claim 3 wherein:

the direction of manipulating the operating rod of said multiple-operation switch is regulated by radial cuts provided in a casing of the electronic apparatus.

5. The multiple-operation switch of claim 2, wherein:

a point of contact of a bottom end of the operating rod is on an axial line connecting the center of the through hole of upper case and the center of the movable contact.

6. An electronic apparatus incorporating the multiple-operation switch recited in claim 5 wherein:

the direction of manipulating the operating rod of said multiple-operation switch is regulated by radial cuts provided in a of the electronic apparatus.

7. An electronic apparatus incorporating the multiple-operation switch recited in claim 2, wherein:

the direction of manipulating the operating rod of said multiple-operation switch is regulated by radial cuts provided in a casing of the electronic apparatus.

8. The multiple-operation switch of claim 1, wherein the first fixed contact point disposed in the lower case comprises:

a central fixed contact point and an outer fixed contact point disposed around the central fixed contact point, and a round dome shape movable contact which is disposed on the outer fixed contact point with the bottom circumference edge making contact thereon.

9. The multiple-operation switch of claim 8, wherein:

the pressure member and the holding member are made of a conductive material, and said pressure member is disposed so as to contact the outer fixed contact point.

10. An electronic apparatus incorporating the multiple-operation switch recited in claim 9 wherein:

the direction of manipulating the operating rod of said multiple-operation switch is regulated by radial cuts provided in a casing of the electronic apparatus.

11. An electronic apparatus incorporating the multiple-operation switch recited in claim 8 wherein:

the direction of manipulating the operating rod of said multiple-operation switch is regulated by radial cuts provided in a casing of the electronic apparatus.

12. The multiple-operation switch recited in claim 1, wherein:

said flange having a polygonal shape attached to the movable contact body is settled in a recessed area, opening downward, provided to take a similar polygonal shape as said flange in the upper case, so that revolving motion of the movable contact body is restricted by side wall of the recess in said upper case.

13. An electronic apparatus incorporating the multiple-operation switch recited in claim 12 wherein:

the direction of manipulating the operating rod of said multiple-operation switch is regulated by radial cuts provided in a casing of the electronic apparatus.

14. An electronic apparatus incorporating the multiple-operation switch recited in claim 1, wherein:

the direction of manipulating the operating rod of said multiple-operation switch is regulated by radial cuts provided in a casing of the electronic apparatus.

15. The electronic apparatus of claim 14, wherein:

a central area formed by the radial cuts provided in the casing of said electronic apparatus is a round hole, when said operating rod of said multiple-operation switch is tilted to as far as an edge of said round hole, certain specific contact points among the second fixed contact points of said multiple-operation switch are brought into an ON state, and when said operating rod is tilted further to as far as the respective ends of said radial cuts the first fixed contact point of said multiple-operation switch is brought into ON state.

16. The multiple-operation switch of claim 1, wherein when no force is being applied to said switch, said holding member contacts a bottom surface of said upper case which limits the upward movement of said holding member thereby preventing said flange from contacting any of said second contact points.

17. An electronic apparatus comprising a multiple-operation switch, said multiple-operation switch comprising:

a lower case made of an insulating material having a recess with an open end positioned upwardly, said lower case having a recessed bottom area comprising a first fixed contact point disposed at a center portion thereof;

a movable contact capable of a stepping action, said movable contact disposed in the recessed bottom area of said lower case such that said movable contact is movable between a first position in which said movable contact engages said first fixed contact point and a second position in which said movable contact does not engage said first fixed contact point;

an upper case made of an insulating material for coupling with said lower case, said upper case having a through hole at the center thereof opposing the recessed bottom area of said lower case, said upper case having a bottom surface around the edge of the through hole formed as a spherical wall, said upper case having a plurality of second fixed contact points provided on the bottom surface thereof, said second fixed contact points positioned equidistant from the center of said through hole;

a holding member being forced upwardly by a pressure member provided in said lower case;

a movable contact body having a through hole in the center and provided around an outer periphery of an upper spherical portion with a conductive flange, said flange being disposed on said holding member and pressed upwardly via the holding member by a pressing force of the pressure member so that said upper spherical portion is engaged with the spherical wall of said upper case such that the movable contact body is able to make a tilting motion, and, when it is tilted, the flange makes contact with at least two of said second contact points; and an operating rod penetrating through the through hole of said movable contact body, said operating rod capable of vertical movement;

wherein the direction of manipulating the operating rod of said multiple-operation switch is regulated by radial cuts provided in a casing of the electronic apparatus, said operating rod being disposed through said casing.

18. The electronic apparatus of claim 17, wherein:

a central area formed by the radial cuts provided in the casing of said electronic apparatus is a round hole, when said operating rod of said multiple-operation switch is tilted to a first edge of said round hole, certain specific contact points among the second fixed contact points of said multiple-operation switch are brought into an ON state, and when said operating rod is tilted beyond said first edge of said round hole, the first fixed contact point of said multiple-operation switch is brought into ON state.

19. The electronic apparatus of claim 17, wherein when no force is being applied to said switch, said holding member contacts a bottom surface of said upper case which limits the upward movement of said holding member thereby preventing said flange from contacting any of said second contact points.

* * * * *